US011129453B2

(12) United States Patent
Eltorai et al.

(10) Patent No.: US 11,129,453 B2
(45) Date of Patent: Sep. 28, 2021

(54) HAND-MOUNTED ILLUMINATION METHOD, SYSTEM, AND DEVICES

(71) Applicant: Handlight Inc., Marlboro, MA (US)

(72) Inventors: Adam E. M. Eltorai, Louisville, KY (US); Jeanette Numbers, Providence, RI (US); Seunghyul Noh, Providence, RI (US)

(73) Assignee: Handlight Inc., Marlborough, MA (US)

( * ) Notice: Subject to any disclaimer, the term of this patent is extended or adjusted under 35 U.S.C. 154(b) by 0 days.

(21) Appl. No.: 16/952,485

(22) Filed: Nov. 19, 2020

(65) Prior Publication Data

US 2021/0215333 A1 Jul. 15, 2021

Related U.S. Application Data

(60) Provisional application No. 62/960,329, filed on Jan. 13, 2020.

(51) Int. Cl.

| | |
|---|---|
| ***A44C 15/00*** | (2006.01) |
| ***F21V 33/00*** | (2006.01) |
| ***F21V 23/04*** | (2006.01) |
| ***F21L 4/00*** | (2006.01) |
| ***F21Y 115/10*** | (2016.01) |

(52) U.S. Cl.

CPC ..... *A44C 15/0015* (2013.01); *F21L 4/00* (2013.01); *F21V 23/0414* (2013.01); *F21V 33/0008* (2013.01); *F21Y 2115/10* (2016.08)

(58) Field of Classification Search

CPC ..... A44C 15/015

See application file for complete search history.

(56) References Cited

U.S. PATENT DOCUMENTS

| | | | | |
|---|---|---|---|---|
| 6,732,469 | B2 * | 5/2004 | Lindgren | A01K 85/01 362/158 |
| 7,703,937 | B2 * | 4/2010 | Shirey | A44C 9/0053 362/103 |
| 8,975,606 | B2 * | 3/2015 | Bowers | F21L 4/00 250/504 R |
| 2003/0206393 | A1 * | 11/2003 | Murray, Jr. | H04N 21/42204 348/734 |
| 2007/0147025 | A1 * | 6/2007 | Shirey | A44C 9/0053 362/103 |
| 2010/0056233 | A1 * | 3/2010 | Thiel | H04R 1/1066 455/575.2 |
| 2012/0103015 | A1 * | 5/2012 | Graham | A44C 9/0061 63/15 |
| 2014/0291556 | A1 * | 10/2014 | Bowers | F21L 4/00 250/504 R |
| 2014/0328053 | A1 * | 11/2014 | Zealer | F21L 4/00 362/157 |
| 2016/0317060 | A1 * | 11/2016 | Connor | A61B 5/681 |
| 2020/0163423 | A1 * | 5/2020 | Nelson | A44C 5/0084 |

* cited by examiner

*Primary Examiner* — Britt D Hanley

(74) *Attorney, Agent, or Firm* — Armis IP Law, LLC

(57) ABSTRACT

A compact precision illumination source mounts on a finger of a user for providing localized illumination for precision tasks such as surgical procedures and other tasks performed in dark or confined spaces. A frame having a circular or arcuate shape engages the finger, and secures an enclosure having a small but powerful bright, light focused on a predetermined region defined by the end of the digit that is likely the activity region for an instrument grasped by the digit.

20 Claims, 6 Drawing Sheets

HAND-MOUNTED ILLUMINATION METHOD, SYSTEM, AND DEVICES

BACKGROUND

Portable light sources for specialized and task lighting contexts are employed wherever fixture lights are impractical or unnecessary. A need for a small portable illumination device has, for some time, been satisfied by a breadth of simple devices commonly referred to as "flashlights."

As an example, surgical environments depict a context where task lighting is paramount. Surgical environments generally require a sterile field to prevent infection and ample lighting to enhance a visual region for the precise manipulation of human tissue. A typical operating room employs a well-defined array of fixtures and procedures for maintaining a sterile environment and ensuring a robust infrastructure of instruments and utilities such as gases, suction, medication, electrical and pneumatic resources, in addition to lighting. Modern Operating Rooms (ORs) define a highly evolved and specialized environment for ensuring effective medical care.

SUMMARY

A compact precision illumination source mounts on a digit of a user for providing localized illumination for precision tasks. A frame having a circular or arcuate shape engages the digit, and secures an enclosure having a small but powerful, bright light focused on a predetermined region defined by the end of the digit that is likely a region of activity for grasped by the digit. Low cost elements such as coin cell batteries and LED (Light Emitting Diodes) contribute to the efficacy of a single-use lighting appliance energized by an unretractable switch or contact closed by device activation. As with many surgical accessories, single-use materials and accessories mitigate cross contamination from other patients or procedures, and cost mitigation in producing single-use devices contributes to feasibility of use.

Configurations herein are based, in part, on the observation that utility lighting for precision manual tasks increases speed, efficiency and accuracy by reducing eye strain and facilitating hand-eye coordination. Unfortunately, conventional approaches to utility lighting in medical and non-medical contexts suffer from the shortcoming that power and space constraints oppose ideals of providing bright illumination in tight, confined spaces as is often the case in a surgical field. Lighting sources need to be either tethered to a power source or rely on onboard batteries; the former interferes with movement and the latter is constrained with a volume of charge material having longevity to span a possibly undetermined duration of a surgical procedure.

Accordingly, configurations herein substantially overcome the above described shortcomings by providing a compact, single-use digit (finger) mounted light aimed generally at the business end of a hand-held instrument and powered by on-board cells stored in an enclosure adjacent a pair of focused LED elements for illuminating the work area, such as a surgical field, of the instrument. The digit mounted illumination source generates and focuses light to mitigate diffusion losses when light is spread over a larger area. Rather, the illumination source is immediately proximate to an object of operator dexterity.

In a basic configuration, a portable, self-contained personal lighting apparatus includes a body having an illumination source and a power supply for illuminating the illumination source. A plurality of deformable prongs extends from the body, such that the prongs are adapted for forming an annular, concave form for resiliently converging around a human digit in a biased clamping or compression fit. The illumination source is then focused on a distal region in a direction defined by the human digit around which the prongs engage, such as a region around a tip of the outstretched digit for lighting a task performed by the finger.

In a particular configuration, a surgical illumination configuration may be provided as disclosed herein, and includes a body having an enclosure and an annular frame. The annular frame has two prongs extending in an arcuate manner from the enclosure, such that the prongs are adapted to engage an index or other finger similar to a jewelry article. The enclosure includes a lighting element, a power supply for powering the lighting element, and a tray for containing the lighting element. The tray is a self-contained assembly including conductive members between the lighting element and power supply for energizing the lighting element. A void on the enclosure is adapted to receive the tray via slidable engagement, such that engagement establishes electrical communication between the power supply and the lighting element as the tray makes a single-use combination.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Depicted below is an example of various configurations of the single-use surgical utility light. Several views and arrangements are shown; other embodiments may be apparent to those of skill in the art by slight variations to the form factor and electrical circuit as shown.

Configurations described below disclose and illustrate a task lighting feature applicable in many contexts based on the small size, finger mount and self-contained power due to a low power draw that need not employ large batteries. A surgical example is discussed as an illustrative case. Such a surgical use invokes many of the features, such as single usage, sterile presentation and task-focus, however many contexts do not require or impose all these constraints. Many tasks are not restricted to sterile instruments, and for the same reason single use enforcement can be waived. Example uses and applications to such non-medical applications may include operation as flashlights, headlights, lamps, torches, searchlight, spotlights, lanterns, etc.; use in fields such as arts, crafts, repair, fishing, camping, hiking, running, nocturnal contexts, biking, vehicle maintenance, around the house, visualization, climbing, spelunking, photography, outdoor sports, hunting, boating, walking, diving, ambulating, manufacturing, warehousing, excavation, electricity generation and power plant operations, custodial work, farming, commercial fishing, logging, landscaping, pest control, food processing, oil field work, waste collection and disposal, recycling, construction, maintenance, shipping, driving, trucking, fashion, orienteering, skiing, backpacking, mountaineering, mountain biking, mining, search & rescue, caving, cataphiles, trouble lights, entertainment, indicators, lighting, communication, signaling, illumination, measuring and interacting, machine vision, biological detection, remote controls, sensor system, safety lamps, wheat lamps, theatrical, cinematic, emergency light, reading, working, nightlight, pointing, decorative, navigation, automotive-related, aviation-related, lamp, laser pointer, polilight, safelight, slit lamp, desk lighting, industry, research, leisure, weapons systems, pet-related, raves, concerts, dance clubs, germicidal, grow light, infrared lamp, strobe, health benefits, safety device, protective gear, rescue equipment, boating, law enforcement, travel, inspection, engineering, instrumenting, tinkering, reading, inspecting wounds, visualize mouth & throat, assess pupil response, view into small openings, look under poorly lit areas, plumbing, veterinary applications, dentistry, hands-free applications, military, control device, task lighting, cameo lighting, photography, security, electrician, manual labor, cooking, machinery and others.

Figure 1:
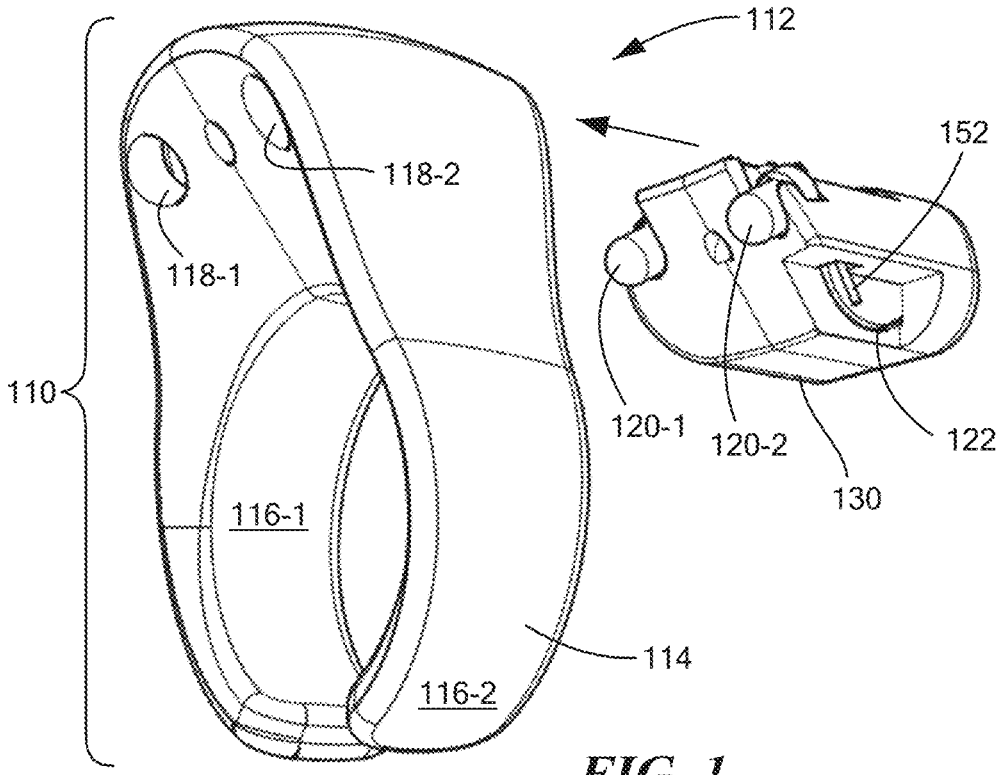
FIG. 1 is a frontal perspective view of the enclosure and tray of surgical illumination device viewed from a left side.
Figure 2:
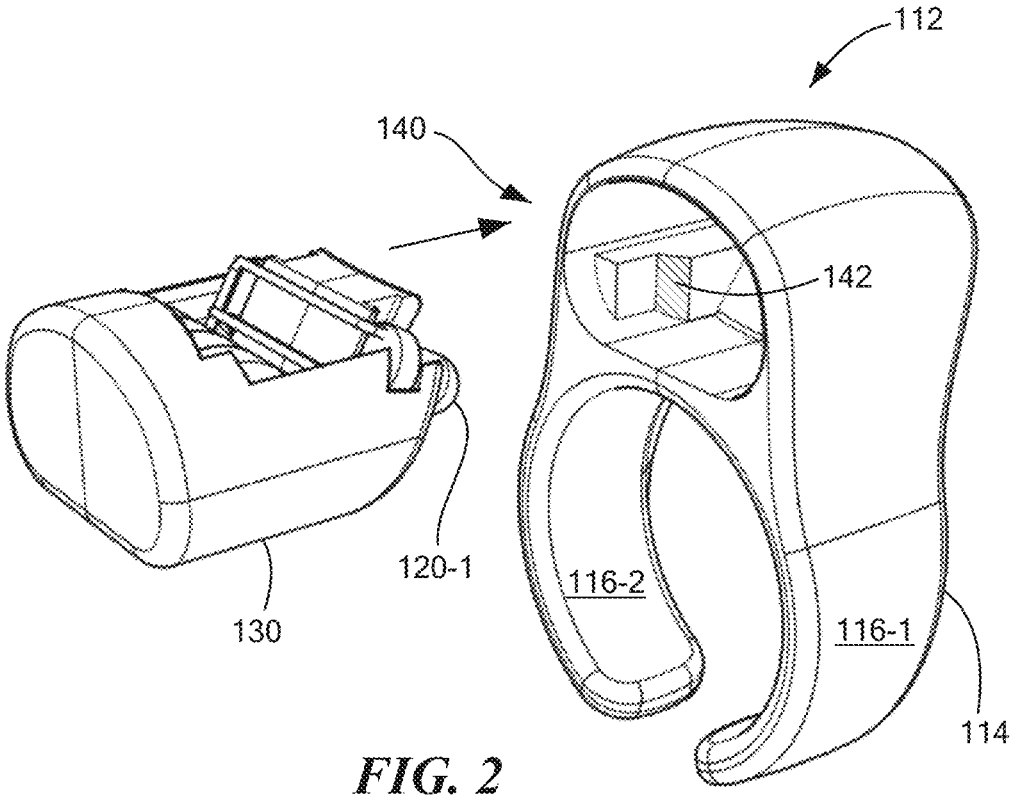
FIG. 2 is a rearward perspective view of the enclosure and tray of the surgical illumination device viewed from a right side.

FIG. 1 is a frontal perspective view of the enclosure and tray of the surgical illumination device viewed from a left side, and FIG. 2 is a rearward perspective view of the enclosure and tray of the surgical illumination device viewed from a right side. Referring to FIGS. 1 and 2, the surgical illumination device 100 includes a body 110 having an enclosure 112 and an annular frame 114. The annular frame has two prongs 116-1 . . . 116-2 (116 generally) extending in an arcuate manner from the enclosure 112, such that the prongs 116 are adapted to engage an elongated member such as the index finger, wrist or other digit of the wearer. The elongated prongs may be of any suitable length to engage, by frictional or compressive bias, or may form a loop.

The enclosure 112 includes on or more lighting elements 120-1 . . . 120-2 (120 generally), a power supply 122 such as a battery for powering the lighting elements 120, and a tray 130 for containing the lighting elements 120. Conductive members 152 extend between the lighting elements 120 and power supply 122 for energizing the lighting element, shown in FIG. 3B below. A void 140 is adapted for slidable engagement with the tray 130, such that the slidable engagement establishes electrical communication between the power supply 122 and the lighting elements 120. A tapered surface 142 may facilitate attachment and locking the tray 130 in the void 140, and may provide electrical actuation for the lighting elements 120, discussed further below. Apertures 118-1 . . . 118-2 (118 generally) in the enclosure 112 align with the lighting elements 120 upon insertion for allowing illumination from the enclosure 112. The power supply 122 is disposed in the tray 130, and further includes an actuator 150 responsive to slidable insertion of the tray 130 into the void 140 for establishing electrical communication. Any suitable mechanism adapted to close (contact) the circuit and power the lighting elements 120 may be provided.

In a first configuration, the device is configured for medical applications as a single use device in sterile environments. The hand light could, of course, be sterilized for subsequent medical use, or employed in non-sterile environments. Alterations for battery removal or rechargeability may, of course, be provided.

Figure 3A:
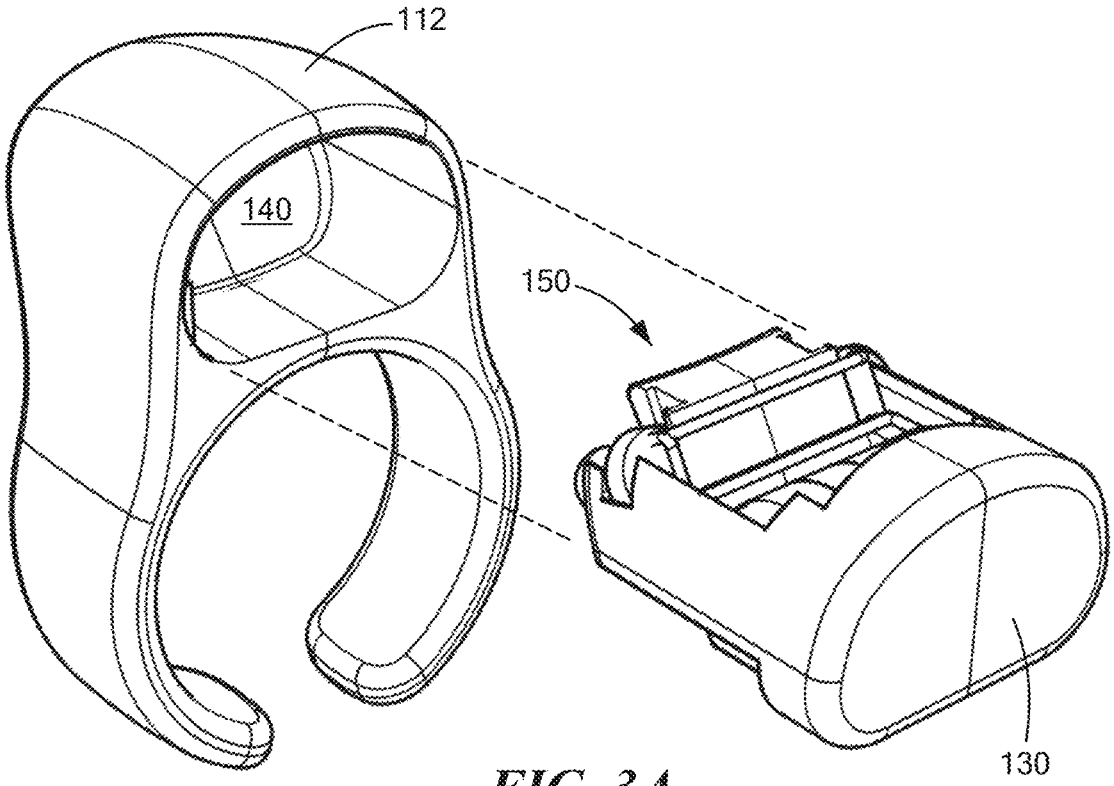
FIGS. 3A and 3B depict circuit operation for the surgical illumination device.
Figure 3B:
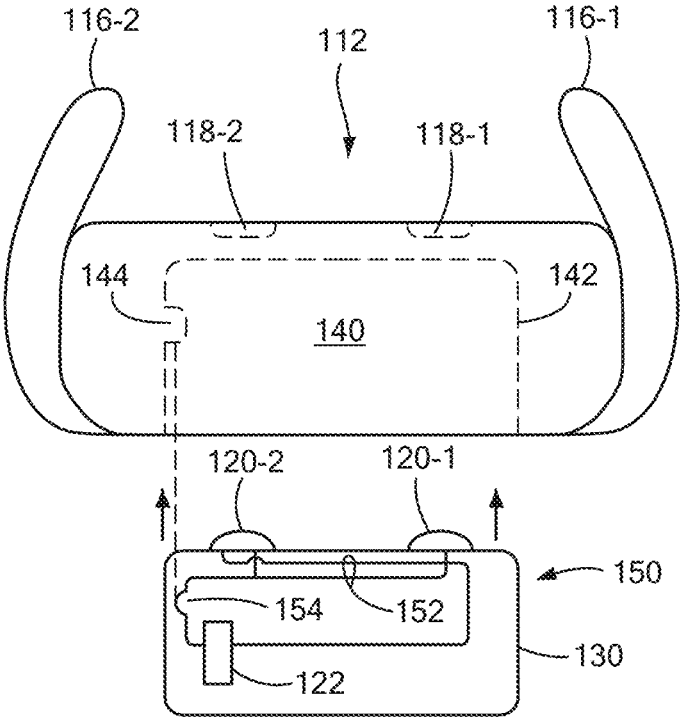

FIGS. 3A and 3B depict circuit 150 operation for the illumination device 100. As the tray 130 slides into the void 140 for device activation, electrical communication between the power supply 122 and lighting elements 120 is established. Any suitable mechanism may be employed, such as a mechanical switch, biased contact, conductive surfaces, inductive coupling, magnetic coupling, or other suitable approach that close (energize) the electrical circuit based on insertion of the tray 130.

The circuit 150 need not encumber the tray 130 with excessive components. The power supply 122 may be a coin cell battery, rechargeable cell or other source. Conductive members 152 such as wires or traces couple the positive and negative terminals of the power supply 122 to the respective terminals of the lighting elements 120, shown as adjacent LEDs 120-1 and 120-2. Any suitable number of lighting elements may be employed based on space constraints; LEDs provide a low power drain which is matched to a longevity of the power supply, and should last a minimum of 4-6 hours but could easily extend to 10 hours for a longer surgical procedure.

The circuit 150 further includes a switch 154, responsive to the engagement of the tray 130 for establishing the electrical communication. The switch 154 may be aligned to engage a protrusion 144 or tapered surface 142 within the void 140 for closing (activating) the circuit as the tray 130 is inserted. The void 140 has a perimeter 142 based on and aligned in close tolerance to the tray 130 size, such that slidable insertion into the enclosure draws the tray adjacent the void 140 interior for causing contact or interference with surface features or aberrations such as the protrusion 144 for actuating the switch 154.

Alternative configurations may replace the switch with a removable tab such as a plastic strip or insulating member disposed biased between the battery and a spring loaded contact may also be employed. The removable tab is disposed to maintain an open circuit by preventing current flow from the battery, and closing the circuit for energizing the lighting element upon removal of the tab. Inaccessibility of the tray or battery provides enforcement of the single-use provision for medical uses, as usage time is therefore limited to the battery life.

The switch may be integrated with a spring biased element for restraining the battery. Conductive members 152 may include a spring biasing for retaining the battery in a conductive manner. The same spring biasing may provide the undetachable engagement by slidably traversing the tapered surface 142, deforming and compressing against the tapered surface, and releasing or "snapping" into a latched arrangement after traversing the tapered side.

Figure 4:
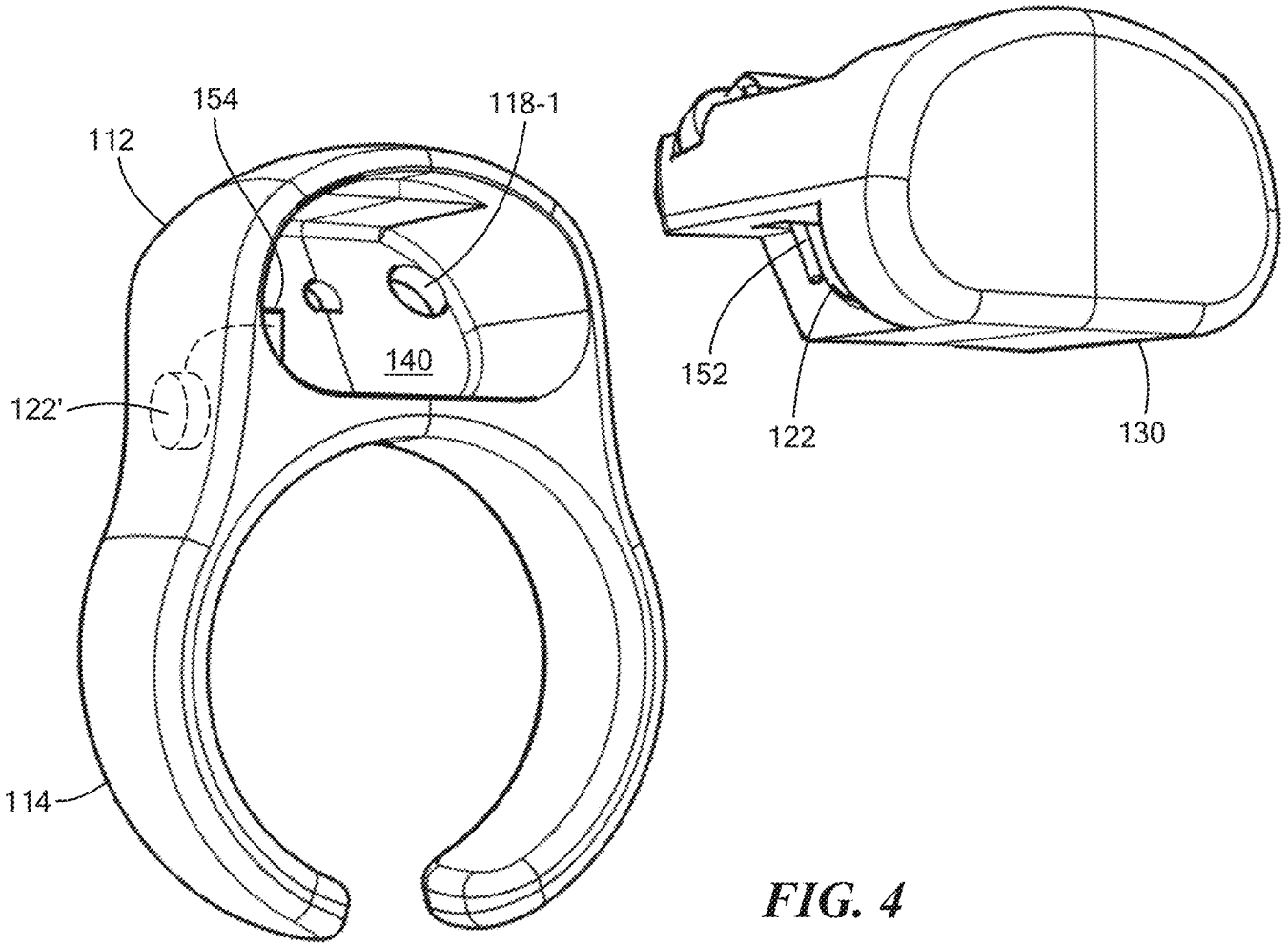
FIG. 4 is a perspective view of the left side of the enclosure and tray of the surgical illumination device viewed from an underside perspective.

FIG. 4 is a perspective view of the left side of the enclosure and tray of the surgical illumination device viewed from an underside perspective. Insertion of the tray 130 into the void 140 may also establish electrical power to the lighting elements based on a power source 122' in the enclosure 112, as well. Alternate approaches for closing the circuit 150 and energizing (powering) the lighting elements 120 upon tray 130 insertion may include a conductive surface on the tray 130, for example. The conductive surface is may attached or connect to the conductive elements 152, and is disposed for slidably engaging a complementary conductive surface on an interior surface of the void, such that slidable engagement of the conductive surface and the complementary conductive surface closes an electrical connection for energizing the lighting elements 120. The alternate power supply 122' in the enclosure 112 energizes the conductive surface; complementary ground connections are also provided.

Figure 5A:
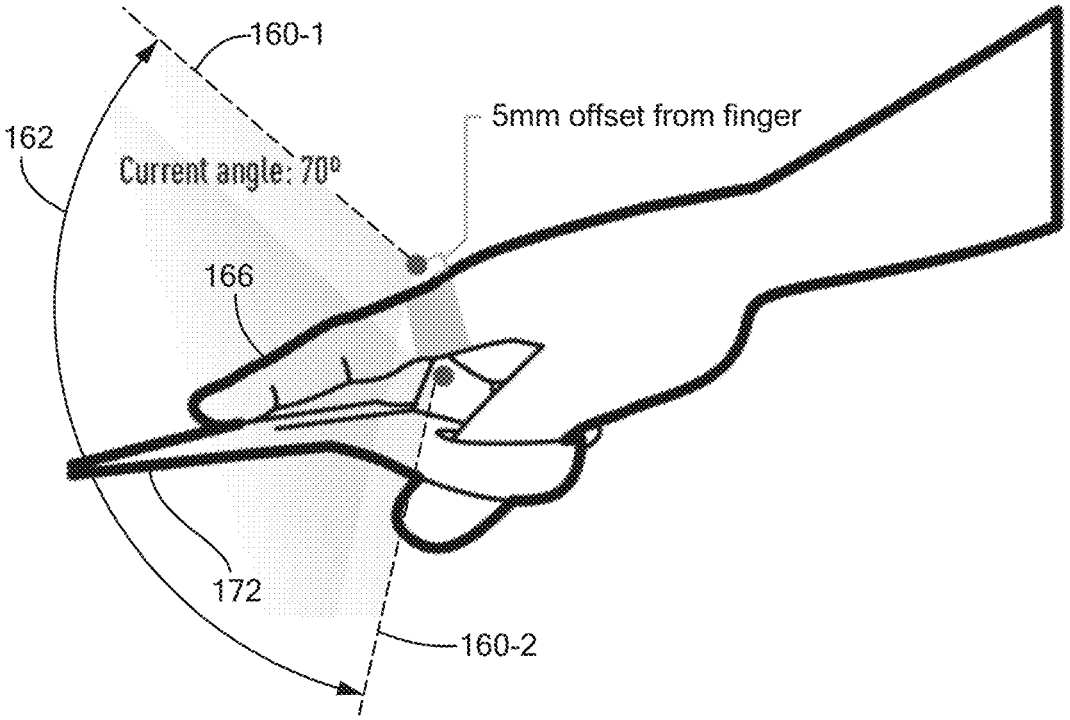
FIGS. 5A and 5B show a projection angle defining a focus of the lighting element in the device of FIGS. 1-4.
Figure 5B:
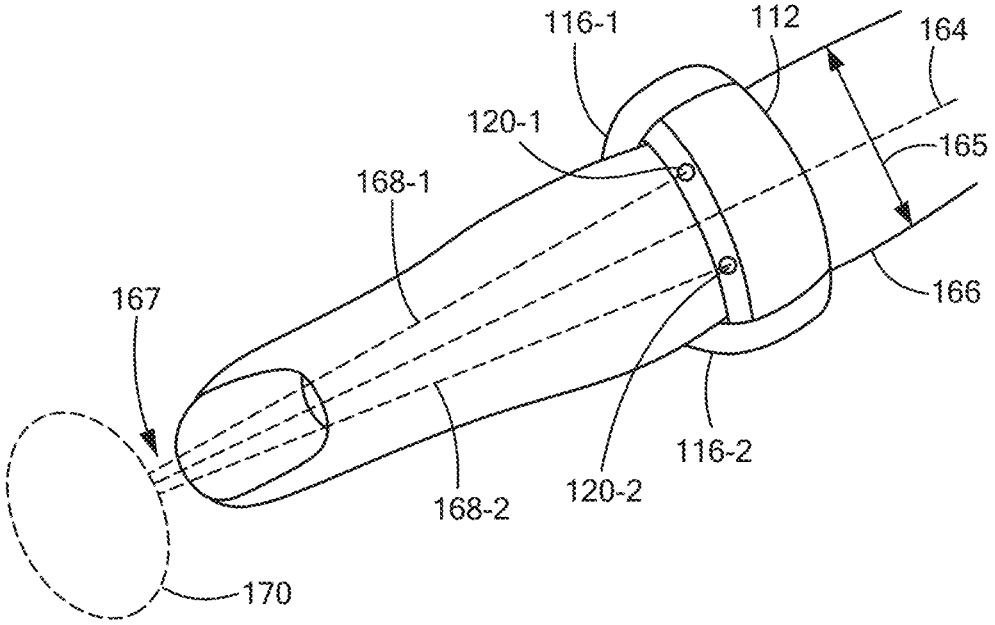

FIGS. 5A and 5B show a projection angle defining a focus of the lighting element in the device of FIGS. 1-4. Referring to FIGS. 1-5B, the lighting elements 120 define a projection angle 162 defined by dotted lines 160-1, 160-2. The projection angle 162 is based an axis 164 extending longitudinally through the engaged elongated member 166 for focusing on a distal end 167 of the elongated member 166. A breadth of the projection angle 166 depends on a periphery of the lighting elements 120, and a beam focus 168-1, 168-2 (168 generally) corresponding to a direction of strongest illumination from each respective lighting element 120, generally around a center of the projection angle 162. The beam focus 168 converges in a work region 170 which is based on activity of a surgical instrument 172 in the surgical field.

The elongated member 166 is expected to be defined by a human digit and the prongs 116 are opposed by a difference less than a diameter 165 of the elongated member 166. Since the light is directed slightly down and in front of the enclosure, an index finger is likely to be used due to the increased dexterity for the task at hand. The elongated members may also engage or wrap around a different carrier such as a wrist or arm of the wearer. The prongs 116 therefore include a deformable material for compressing the prongs in opposed directions for disposing the prongs 116 at a distance providing a frictional engagement with the elongated member 166. Resiliency of the deformable material biases the prongs against the elongated member 166, such that the prongs 116 retain the enclosure 112 by a bias against the elongated member 166. In alternate arrangements, the 116 prongs may have a closure defining a circular shape adapted for slidable communication with the elongated member, thus securing the enclosure as a ring of jewelry is frictionally secured around a finger.

Figure 6:
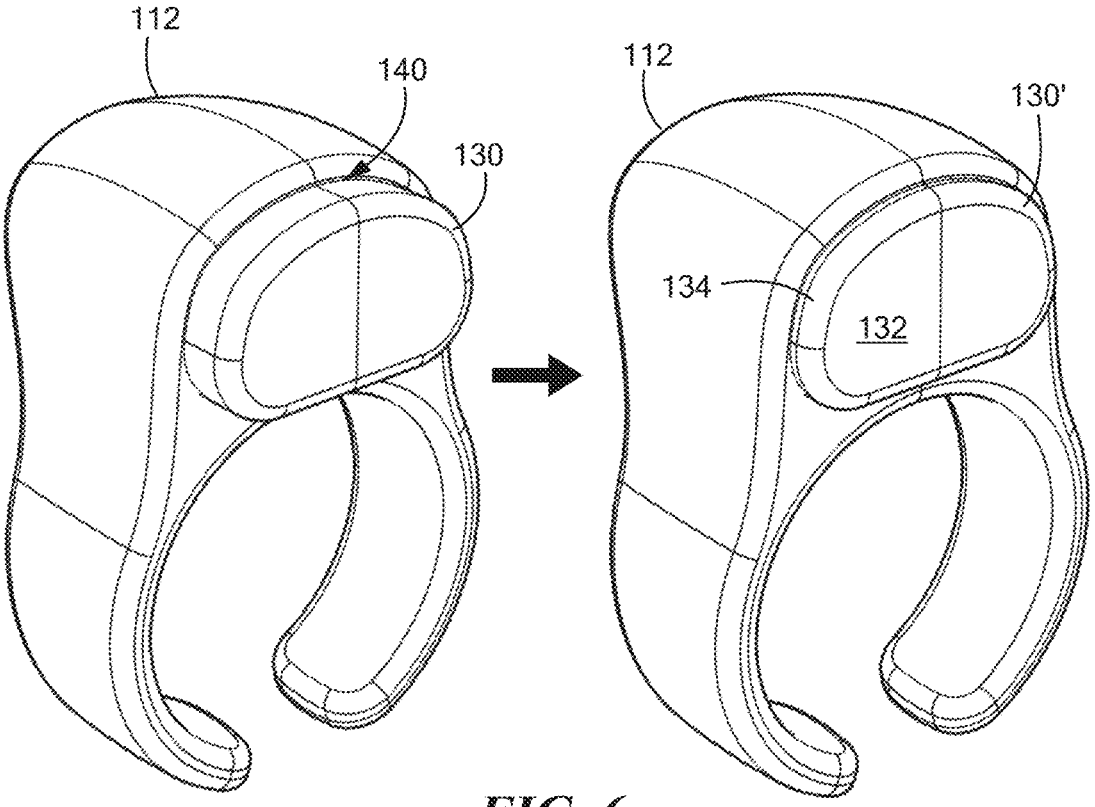
FIG. 6 shows a transition of the tray to an engaged, undetachable orientation.

FIG. 6 shows a transition of the tray 130 to an engaged, undetachable orientation. Referring to FIGS. 1-6, the tray 130 engages the void 140 in an undetachable manner, once the tray 130 fully engages the void 140, actuating the switch 154 and aligning the lighting elements 120 with the apertures 118. The engaged tray 130' remains secured and undetachable for enforcing the single-use provision of the device 100. No tabs, ridges or engaging surfaces are provided on the exposed tray panel 132. A tapered edge 134 aligns to provide a generally smooth, gently angled transition for resisting prying or interference with the now permanent tray 130' engagement with the enclosure 112. The tray 130-void 140 engagement may further include latch actuated by the tapered surface 142 for engaging the tray 130 in an undetachable manner upon insertion into the void 140.

For example, a deformable protrusion may extend from the tray, such that the deformable protrusion is disposed for slidable communication with the tapered surface 142. Upon tray 130 insertion, the deformable protrusion returns to an undeformed state to define a latching, interference fit with the enclosure 112 for preventing tray withdrawal.

Figure 7:
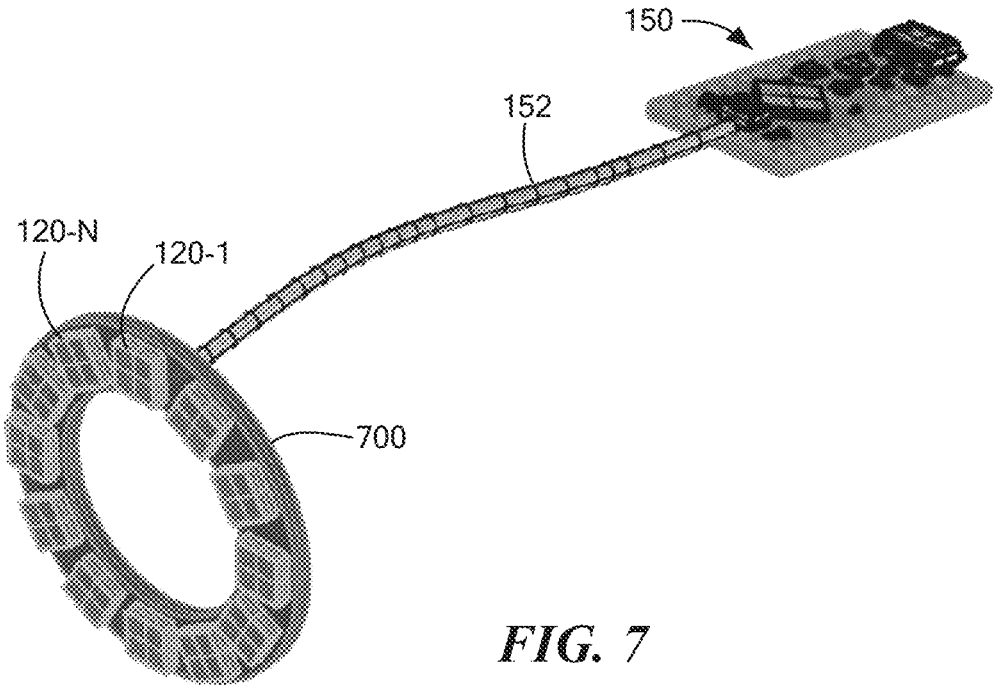
FIG. 7 shows an alternate configuration having the lighting elements arranged in a circumferential manner.

FIG. 7 shows an alternate configuration having the lighting elements arranged in a circumferential manner. A circular array 700 defines a mounting for lighting elements 120-1 . . . 120-N. The circuit 150 attaches to the circular array 700 via conductive members 152. The circular array 700 may be frictionally engaged around the elongated member 166.

Figure 8:
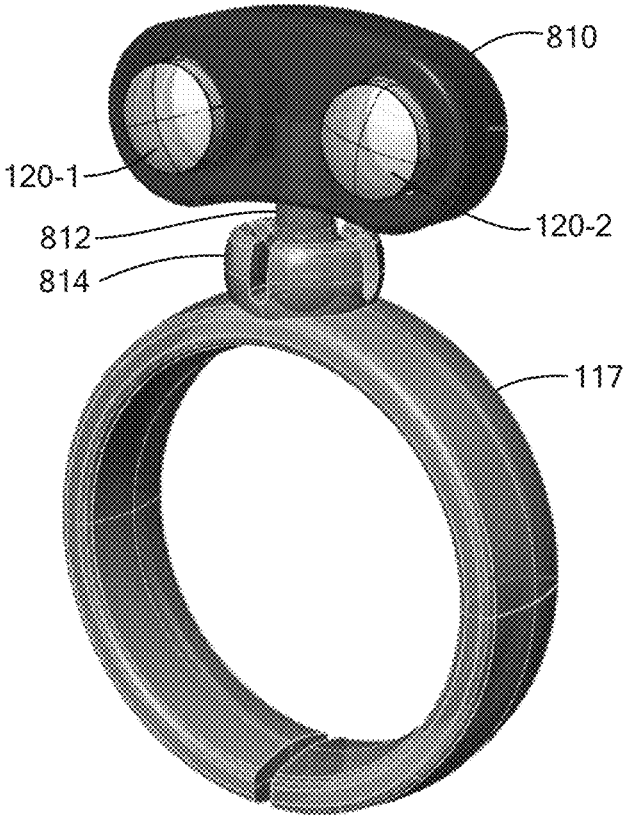
FIG. 8 shows an alternate configuration for varying the projection angle of the device of FIGS. 1-4.

FIG. 8 shows an alternate configuration for varying the projection angle of the device of FIGS. 1-4. In FIG. 8, the prongs 116 form a complete circular frame 117 as a jewelry item might fit. Lighting elements 120 reside in a pivoting attachment 810 secured to the circular frame 117 by a ball 812 and socket 814 arrangement.

Figure 9:
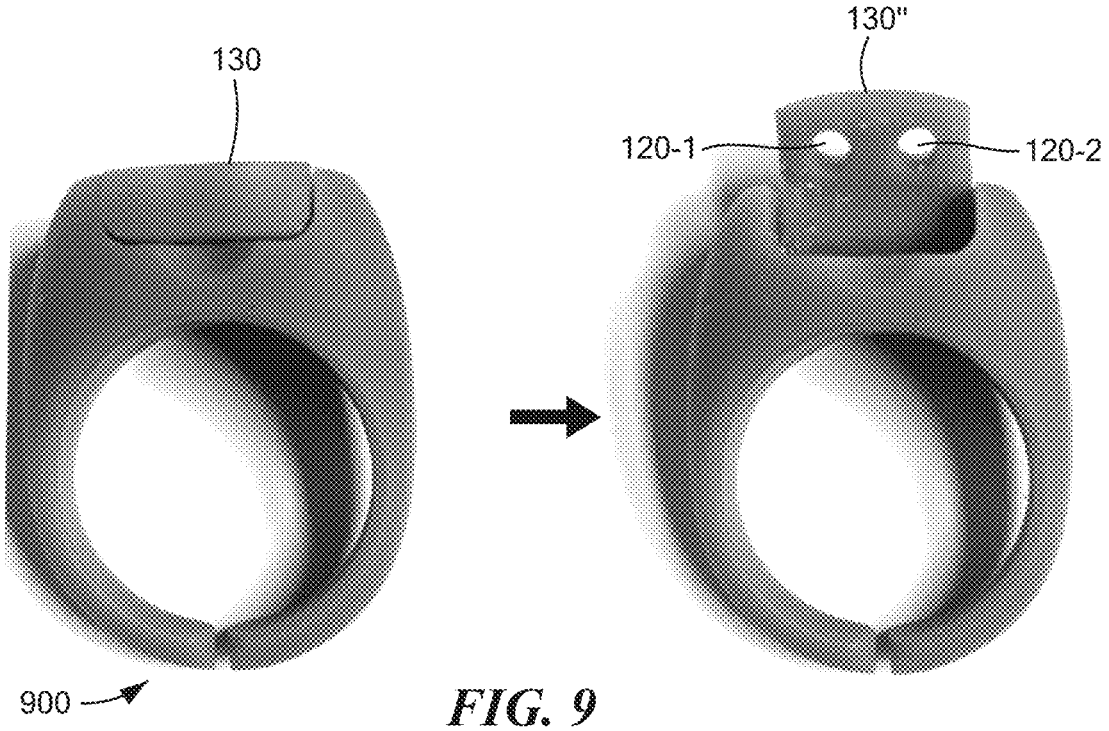
FIG. 9 shows an alternate configuration for concealing and altering the projection angle as in FIGS. 1-4.

FIG. 9 shows an alternate configuration for concealing and altering the projection angle as in FIGS. 1-4. FIG. 9 shows a device 900 hinged tray 130 that transitions to an open position 130" to expose and position the lighting elements 120. The hinge allows adjustment of the projection angle 162 to suit the task at hand.

In alternate configurations, the surgical illumination device provides a general utility light by relaxing the single-use feature. This may be provided by a detent or hook on the tray for power supply 122 refresh (battery replacement). Alternatively, the power supply may be a rechargeable (lithium-ion or other battery chemistry) cell. Usage in a common (non-sterilized/operating room) context may of course be a popular usage context and need not invoke the single-use provision. A rechargeable and/or replaceable battery is particularly beneficial. In the case of a replaceable battery, the tray need not be locking, but rather provides battery access. In a rechargeable configuration, an electrical recharge connection is included. A USB (Universal Serial Bus) socket or similar connection for miniature and personal electronic devices may be employed.

While the system and methods defined herein have been particularly shown and described with references to embodiments thereof, it will be understood by those skilled in the art that various changes in form and details may be made therein without departing from the scope of the invention encompassed by the appended claims.

What is claimed is:

1. A method for providing finger-mounted illumination, comprising:

providing a body having an enclosure and an annular frame;

the annular frame having one or more elongated prongs extending in an arcuate manner from the enclosure, the prongs adapted to engage with a human digit;

the enclosure including:

a lighting element;

a power supply for powering the lighting element;

a tray for containing the lighting element;

conductive members between the lighting element and power supply for energizing the lighting element;

an insulating tab interrupting the conductive members from establishing a closed circuit between the power supply and the lighting element; and receiving the tray into a void adapted for slidable engagement with the tray;

establishing as a result of removal of the insulating tab, electrical communication between the power supply and the lighting element.

2. A finger-mounted illumination device, comprising:
a body having an enclosure and an annular frame;
the annular frame having one or more elongated prongs extending in an arcuate manner from the enclosure, the prongs adapted to engage a human digit;
the enclosure including:
a lighting element;
a power supply for powering the lighting element;
a tray for containing the lighting element;
conductive members between the lighting element and power supply for energizing the lighting element; and
a void adapted for slidable engagement with the tray, the slidable engagement establishing electrical communication between the power supply and the lighting element.

3. The device of claim 2 wherein the power supply is disposed in the tray, further comprising an actuator responsive to slidable insertion of the tray into the void for establishing electrical communication.

4. The device of claim 2 further comprising a switch, the switch responsive to the engagement for establishing the electrical communication.

5. The device of claim 2 further comprising a removable tab, the removable tab disposed to maintain an open circuit, the circuit closing for energizing the lighting element upon removal of the tab.

6. The device of claim 2 wherein the tray engages the void in an undetachable manner.

7. The device of claim 2 further comprising a latch, the latch actuated by a tapered surface for engaging the tray in an undetachable manner upon insertion into the void.

8. The device of claim 2 further comprising a deformable protrusion extending from the tray, the deformable protrusion disposed for slidable communication with the tapered surface, the deformable protrusion returning to an undeformed state defining an interference fit with the enclosure for preventing tray withdrawal.

9. The device of claim 2 further comprising a conductive surface on the tray, the conductive surface disposed for slidably engaging a complementary conductive surface on an interior surface of the void, the slidable engagement of the conductive surface and the complementary conductive surface closing an electrical connection for energizing the lighting element.

10. The device of claim 2 wherein the lighting element defines a projection angle, the projection angle based an axis extending longitudinally through the engaged human digit for focusing on a distal end of the human digit.

11. The device of claim 10 wherein the prongs are opposed by a distance less than a diameter of the human digit for biasing the prongs against the human digit.

12. The device of claim 10 wherein the prongs include a deformable material for compressing the prongs in opposed directions for disposing the prongs at a distance providing a frictional engagement with the human digit, such that the prongs are opposed by a distance less than a diameter of the human digit for biasing the prongs against the human digit.

13. The device of claim 10 wherein the prongs have a closure defining a circular shape adapted for slidable communication with the human digit.

14. The device of claim 2 further comprising a manual switch, the manual switch responsive to a user input for establishing the electrical communication.

15. The device of claim 2 wherein the body is adapted for sterilization by construction from heat resistant materials and sealing of the enclosure.

16. The device of claim 2 further comprising a rechargeable power supply and an electrical coupling for charging the power supply.

17. A method for providing task illumination comprising using a finger-mounted illumination device having deformable prongs;
disposing the prongs in opposed directions for biasing the prongs in a frictional engagement with an elongated member;
closing an electrical circuit between an illumination source and a power supply for emitting outward directed visible light for utility lighting; and
directing the outward directed visible light at a distal region based on a directional focus of the engaged elongated member.

18. A portable, self-contained personal lighting apparatus, comprising:
a body having an illumination source and a power supply for energizing the illumination source, the illumination source defined by one or more outward emitting lighting elements for utility lighting; and
a plurality of deformable prongs extending from the body, the prongs adapted to form an annular, concave form for resiliently converging around a human digit,
the illumination source focused on a distal region in a direction defined by the human digit.

19. The apparatus of claim 18 wherein the outward emitting lighting source is one or more visible light emitting LEDs (light emitting diodes).

20. The apparatus of claim 18 further comprising a plurality of electrical contacts for closing a circuit between the illumination source and the power supply.

* * * * *